United States Patent [19]

Magnier et al.

[11] Patent Number: 4,969,836

[45] Date of Patent: Nov. 13, 1990

[54] UNIVERSAL CONNECTION ASSEMBLY FOR CONNECTING A PROCESSING TERMINAL TO A DATA TRANSMISSION NETWORK

[75] Inventors: Bernard Magnier, Cadenet; Juan Bezada, Guyancourt, both of France

[73] Assignees: Bull S.A., Paris; Interconnection Informatique, Pertuis, both of France

[21] Appl. No.: 426,753

[22] Filed: Oct. 26, 1989

[30] Foreign Application Priority Data

Oct. 27, 1988 [FR] France ..... 88 14043

[51] Int. Cl.[5] ..... H01R 29/00

[52] U.S. Cl. ..... 439/188; 439/137; 439/344

[58] Field of Search ..... 439/137, 142–144, 439/188, 259, 263, 265, 344, 400

[56] References Cited

U.S. PATENT DOCUMENTS

| | | | |
|---|---|---|---|
| 4,767,357 | 8/1988 | Hasircoglu | 439/499 |
| 4,772,215 | 9/1988 | Falk | 439/188 |
| 4,790,769 | 12/1988 | Kanada | 439/344 |
| 4,911,650 | 3/1990 | Ramos | 439/188 |

FOREIGN PATENT DOCUMENTS 2231130 12/1974 France .

*Primary Examiner*—Paula A. Bradley

*Attorney, Agent, or Firm*—Kerkam, Stowell, Kondracki & Clarke

[57] ABSTRACT

The invention relates to a universal assembly for connecting a processing terminal to a data transmission network. This assembly is constituted by a female connector (15) and a male connector (18). The female connector has two groups of connection terminals (28, 29) connected to ends of lines of network cable sections (7, 8). The male connector (18) is connected to a connection cable (5) of the terminal and has connection terminals (21) respectively entering into contact with a group of terminals (28, 29) of the female connector. This assembly also has, in the female connector, electrical, mobile linking means (35) retractable on inserting the male connector (18) in order to ensure the continuity of the communications on the network, prior to insertion and for ensuring the connection of the terminal to the network after insertion. Means are provided for ensuring the continuity of the earth or ground shields of the terminals of the male and female connectors and the shields of the cables. The invention has particular application to the connection of terminals to telephone and computer networks.

22 Claims, 7 Drawing Sheets

Figure 3:
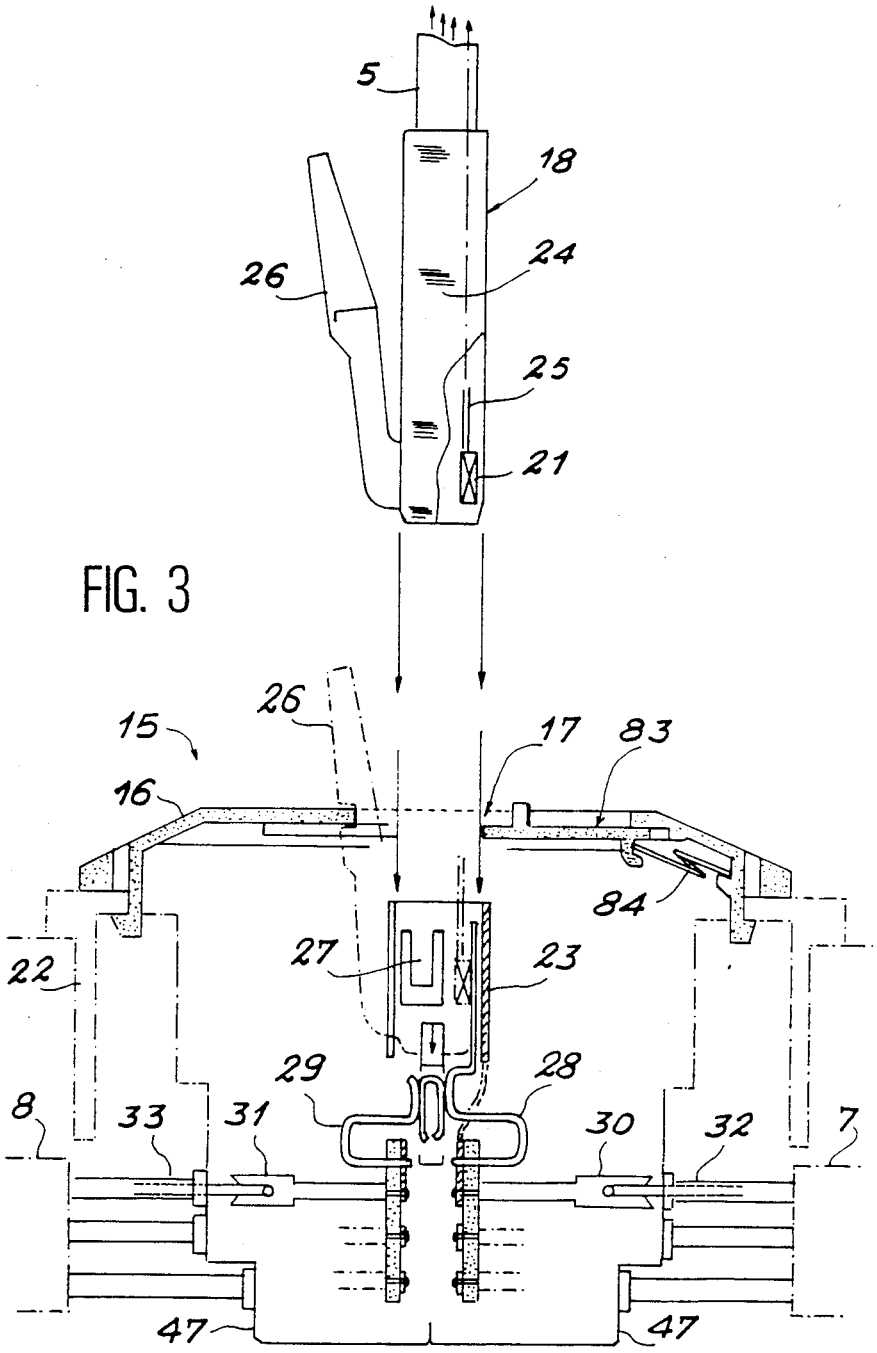

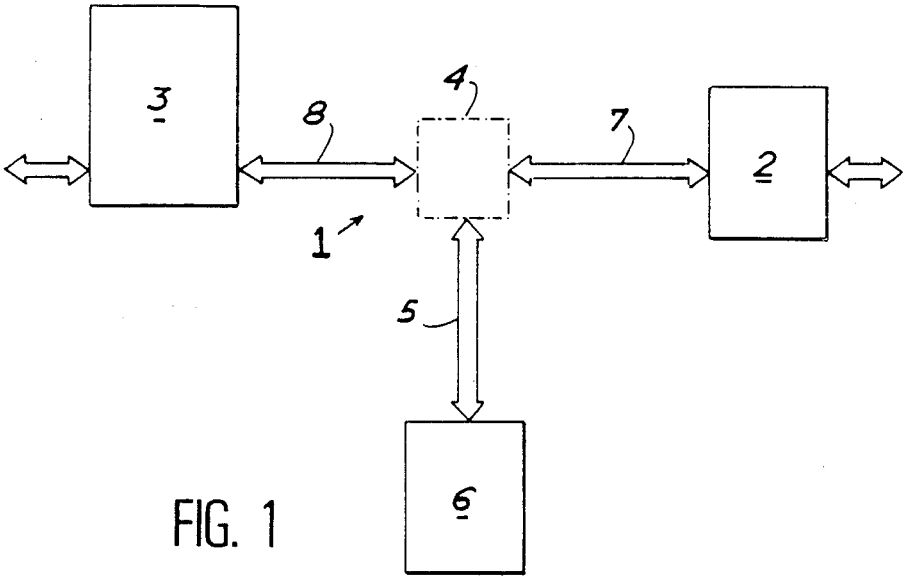
FIG. 1
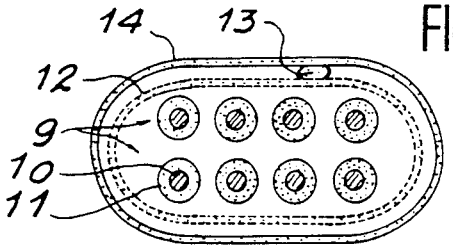
FIG. 2
FIG. 7
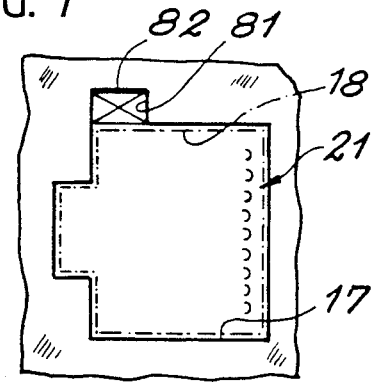
FIG. 8
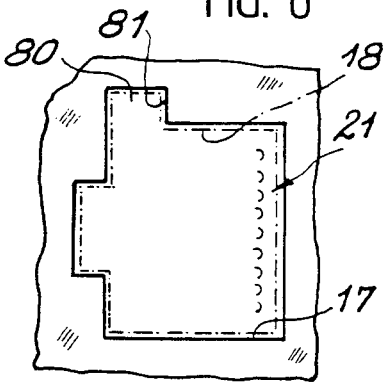

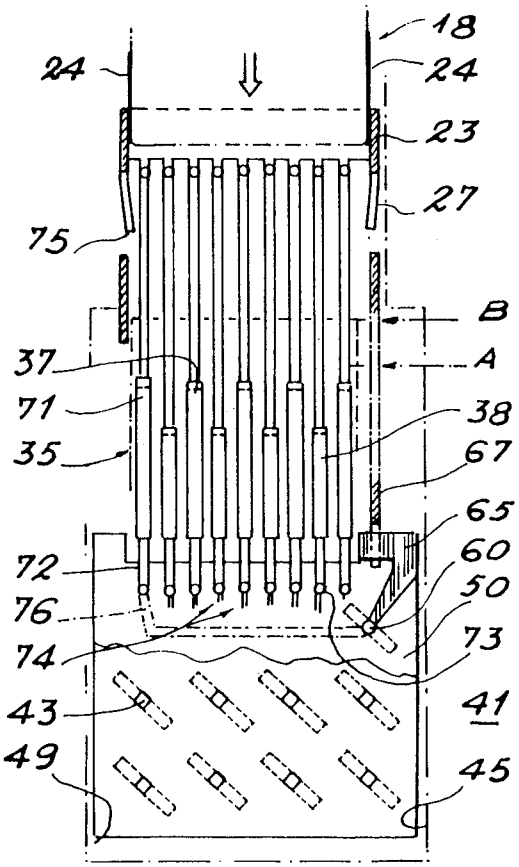
FIG. 6
FIG. 5
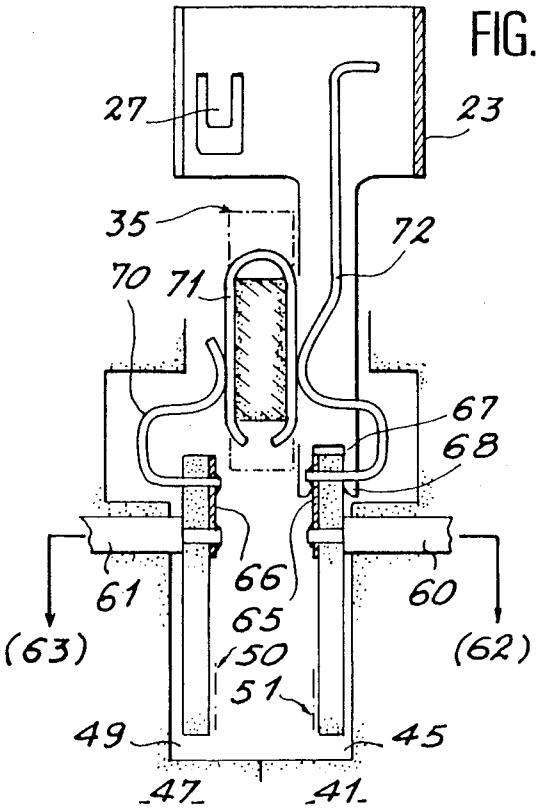

UNIVERSAL CONNECTION ASSEMBLY FOR CONNECTING A PROCESSING TERMINAL TO A DATA TRANSMISSION NETWORK

The present invention relates to a universal connection assembly for connecting a processing terminal to a data transmission network.

The invention applies to data transmission networks using multiline cables and more particularly so-called "twisted pair" multiline cables having an earth or ground shielding eliminating unwanted noise in transmissions. In this type of cable, data transmission takes place in one direction in one of the lines of each pair and in the opposite direction in the other line of said pair.

It is known that the networks may or may not be local and permit the transmission of computer data (the networks e.g. known under the names STARLAN, ETHERNET, TOKEN RING, etc.) or digital telephone data transmissions (e.g. the RNIS or service integration digital network). It is indispensable to be able to connect in parallel on each network and in simple terms one or more computer and/or data terminal equipments (DTE) as a function of the considered network type. These data terminal equipments are also referred to as terminals or stations.

This connection of a terminal to a network causes problems specific to each network, which are particularly due to the architecture of the network in question (star, bus, tree and similar architectures) and the type of connecting interface used in the network (e.g. standardized links V11 or V24). Thus, the connection of a terminal to a network takes place by means of an appropriate connection assembly having a female connector connected to two successive sections of said network and a male connector connected to the terminal. This connection assembly must ensure the continuity of data transmissions on the network prior to the connection of the terminal by inserting the male connector in the female connector and, as a function of the network architecture and the interface type, must permit at the time of said interruption a total or partial breaking of transmissions on the network in order to totally or partly divert these transmissions to the terminal, or conversely causing no transmission break on the network.

Another problem appears when the multiline cable sections used for transmissions on the network and for the connection of a terminal thereto are provided with an earth shield or shielding. It is then indispensable to ensure an electrical continuity of the shields of the cable sections of the network and the connecting cable. It is also indispensable to provide a shielding of the connecting terminals of the male connector, outside said connector, as well as a shielding of the connecting terminals of the female connector, within said connector. These external and internal shieldings must be connected to those of the cables of the network and to the shield of the terminal connecting cable.

Another problem occurs as a result of a recent international standard ISO8877 relating to connection assemblies usable in networks and which defines for each assembly the location of the connecting terminals of the male and female connectors, the outer shape of the male connector and the shape of an inlet window on a front face of the female connector permitting the insertion of the male connector.

At present there is no connection assembly which can be called universal, i.e. which permits the connection of a terminal to a network with a total or partial break, or without any break in transmissions on the network, which ensures a continuity of the shields of the transmission cables of the network and the connection cables of the terminal, as well as the shields for the male and female connectors. There is also no connection assembly having all the shield continuity and transmission characteristics referred to hereinbefore, whilst still respecting standard ISO8877. There is also no connection assembly having foolproofing means making it possible to prevent the connection of a computer or data processing terminal to a telephone-type plug.

The invention aims at obviating these disadvantages by means of a universal connection assembly, which can be adapted to any network type, which permits a parallel connection of a terminal to the network with total or partial breaking or without breaking of transmissions on the network.

In the case where the network transmission cables and the terminal connecting cable have an earth or ground shield, this connection assembly also makes it possible to ensure a continuity of said shield with the shields of the connecting terminals of the male and female connectors. Finally, this connection assembly is in accordance with ISO standard 8877.

The invention more specifically relates to a universal connection assembly for connecting a processing terminal to a data transmission network by multiline cable comprising:

a female connector having a box provided with an inlet window on a front face of said box and, within the box and facing the window, connection terminals respectively connected to corresponding ends of transmission lines of a first and a second successive sections of cables of the network;

a male connector having connection terminals respectively connected to lines of a multiline connection cable of said terminal, the connection terminals of the male connector respectively coming into contact, by sliding, with the corresponding terminals of the female connector, during the insertion of the male connector into said window for connecting the terminal to the network, characterized in that it comprises:

a first group of connection terminals of the female connector respectively connected by first connection means to the corresponding ends of cable lines of the first section and respectively coming into contact with the connection terminals of the male connector during said insertion;

a second group of connection terminals of the female connector respectively connected by second connection means to corresponding ends of the lines of the cable of the second section; and electrical linking means, which are mobile and retractable under the thrust of the male connector on insertion, located within the female connector and moving between the terminals of the first and second groups of the female connector, in order to ensure the continuity of communications on the network prior to said insertion and for ensuring the connection of the terminal to the network after said insertion.

According to an embodiment of the invention, the mobile means of the electrical links have a mobile support displaced by the male connector during insertion, as well as a group of electrical U-links, each U-link having two branches respectively in contact with a terminal of the first group and with a corresponding terminal of the second group of the female connector prior to insertion, said U-links having all the branches of a first length, or all of a second length less than the first length, said group of U-links forming a first U-link assembly with branches of the first length and a second U-link assembly having branches of the second length.

According to another embodiment, the connection assembly comprises:

a shield for the connection terminals of the female connector forming a sleeve at least partly enveloping the connection terminals of the female connector within said box and means for ensuring the electrical continuity of the shield of the female connector with the respective shielding lines of the first and second sections of cables of the network, a shield outside the male connector forming another sleeve partly enveloping the terminals of the male connector, said sleeve being in contact with a shielding line of said connecting cable of the terminal and coming into contact with the shield of the female connector during insertion.

The invention is described in greater detail hereinafter relative to non-limitative embodiments and the attached drawings, wherein show:

FIG. 1 Diagrammatically a data transmission network using a connection assembly according to the invention.

FIG. 2 Diagrammatically and in cross-section a multiline cable with earth or ground shielding, used in a communications network, where the connection assembly according to the invention is used.

FIG. 3 Diagrammatically and in cross-section a connection assembly according to the invention, the male connector being inserted in the female connector.

Figure 4:
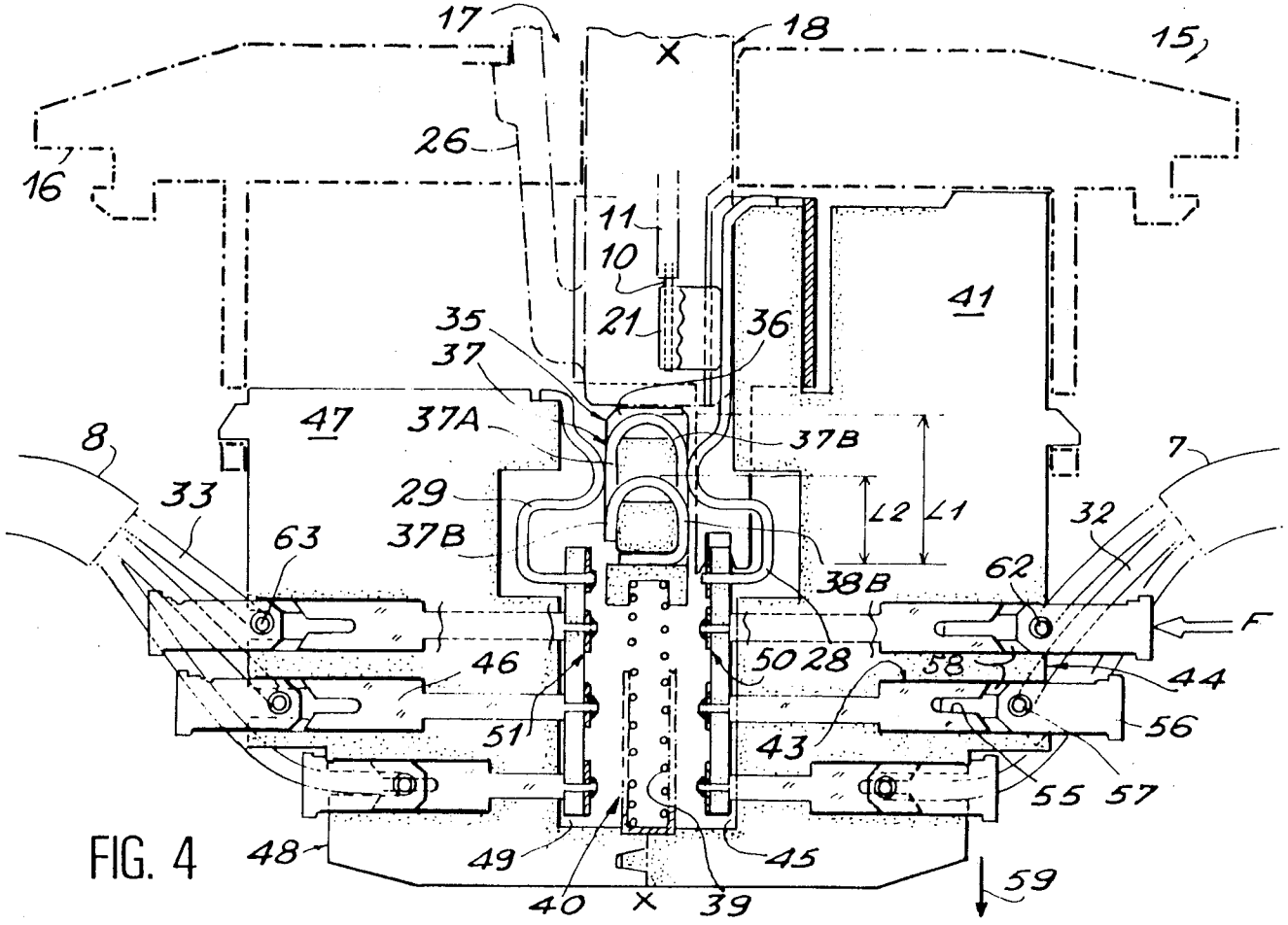

FIG. 4 Diagrammatically and in cross-section, a connection assembly according to the invention, the male connector not being inserted in the female connector.

FIG. 5 Diagrammatically and in cross-section, the interior of the female connector in the vicinity of the internal shielding means.

FIG. 6 Diagrammatically and in longitudinal section, the retractable, mobile linking means used in the female connector according to the invention.

FIGS. 7 and 8 Diagrammatically the insertion window on one front face of the female connector, said window being provided with foolproofing means, for different applications of the connection assembly.

Figure 9A:
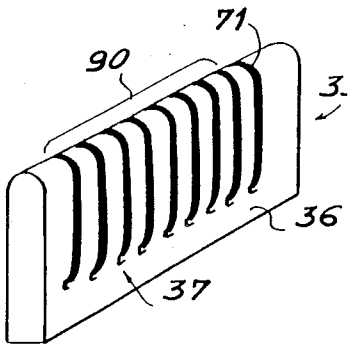
Figure 10A:
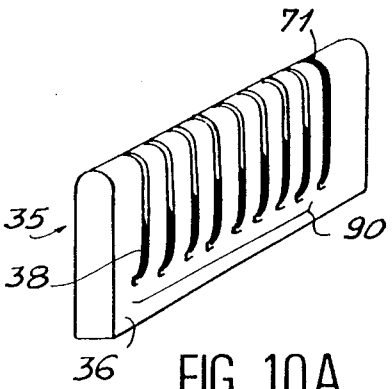
Figure 11A:
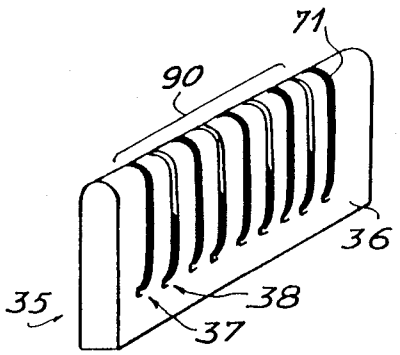

FIGS. 9A, 10A, 11A Diagrammatically and in perspective, different embodiments of the retractable linking means of the connection assembly according to the invention making it possible to render said assembly universal in its applications.

Figure 9B:
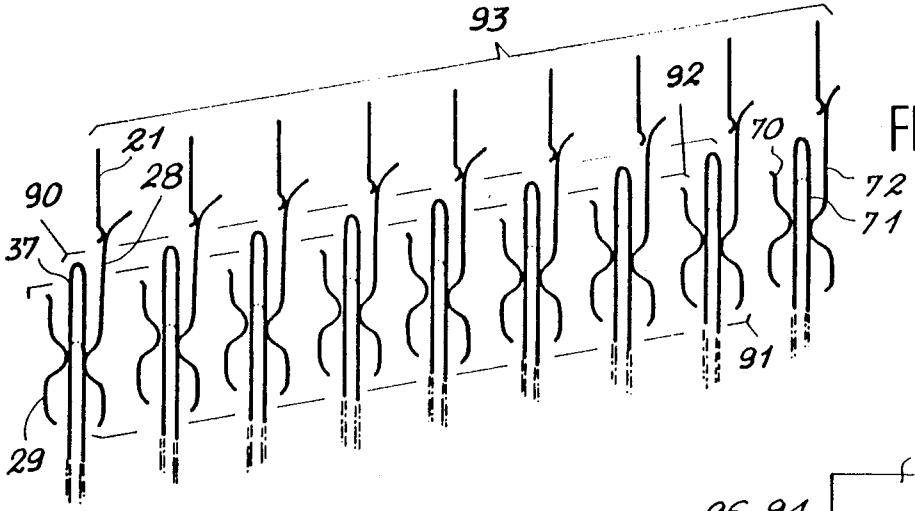
Figure 10B:
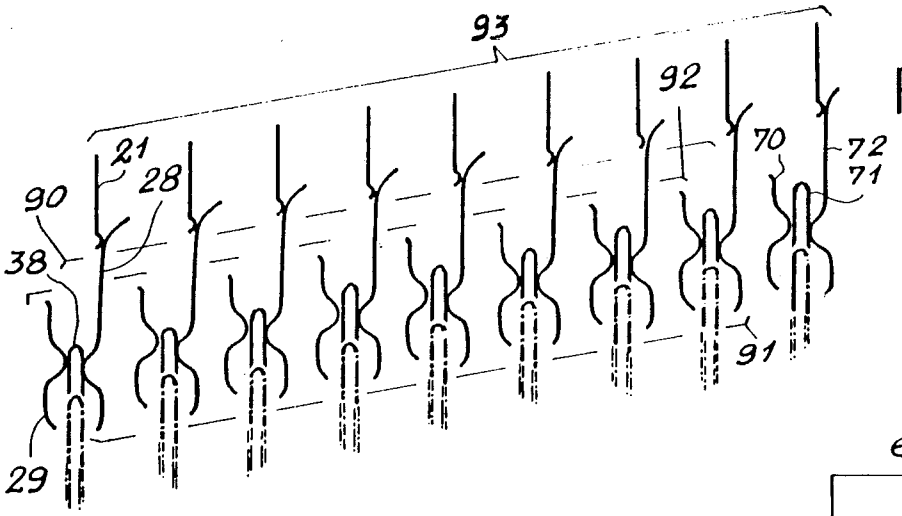
Figure 11B:
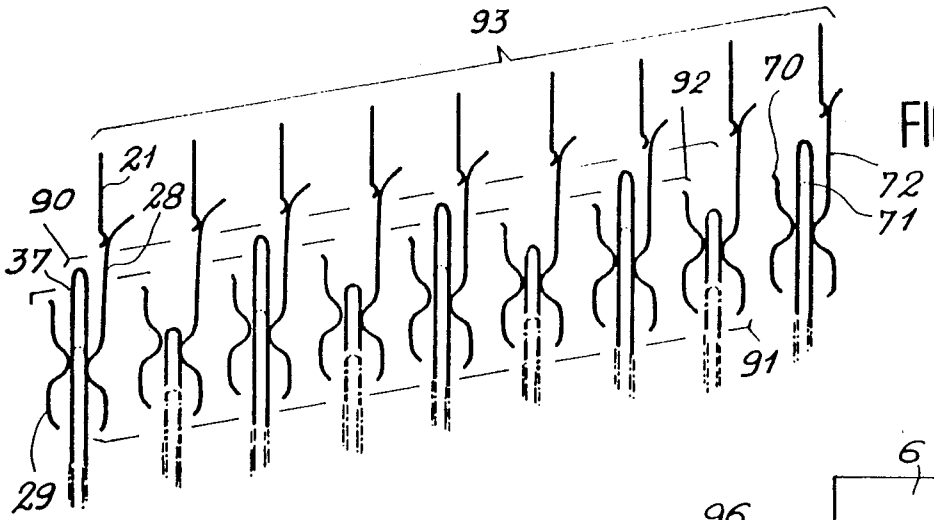

FIGS. 9B, 10B, 11B Diagrammatically and in perspective, respectively for the preceding embodiments, the U-links used in the retractable, mobile means and their positions relative to the connection terminals of the female connector, when the mobile means are in the retracted or free position.

Figure 11C:
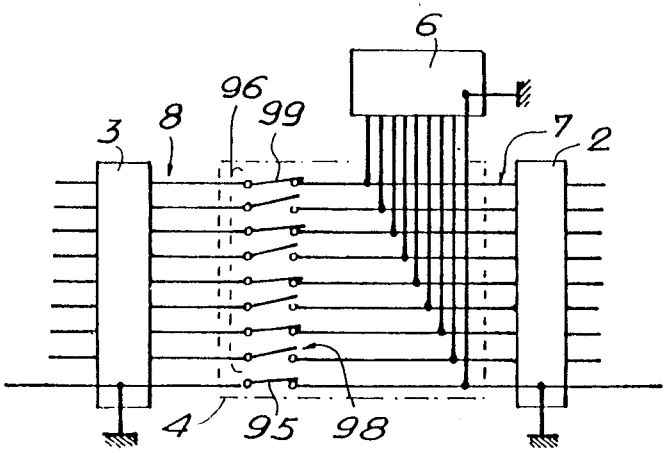

FIGS. 11A, 11B, 11C Diagrammatically, respectively for the preceding embodiments, the different connection types of a terminal to the network, obtained for each embodiment.

FIG. 1 diagrammatically shows a network 1 for transmitting data between two stations 2, 3 communicating by means of a multiline cable e.g. having an earth or ground shield. This cable will be described in greater detail hereinafter. The connection assembly 4 according to the invention makes it possible to connect in parallel on said network by a connection cable 5, another terminal or another station 6. This connection assembly incorporates a female connector connected to two successive cable sections 7, 8 of the network communications cable and a male connector connected to the connection cable 5. Connection cable 5, like the network transmission cable sections 7, 8 is preferably a multiline cable with earth shielding.

FIG. 2 is a diagrammatic cross-section of one of the sections 7 or 8 of the transmission cable of the network, or the connection cable 5. In this case, the cable has eight conducting lines, like line 9, each being constituted by a conductor 10 surrounded by an insulating covering 11. This cable can be called a cable with four twisted pairs. It also has an earth shield 12, e.g. constituted by a metal envelope wound around lines 9. At least one shielding conducting line 3 in contact with the metal envelope 12 facilitates the interconnection of the earth shields of different cable sections. An insulating covering 14 surrounds the shielding envelope 12 and the shielding conducting line 13. In this type of multiline cable, as indicated hereinbefore, certain lines ensure transmissions in a first direction, whilst other lines ensure transmissions in the opposite direction. The earth shielding line is generally connected to the earth of the terminal or the station connected to said cable. However, in certain cases said shielding line can carry a signal.

FIG. 3 is a diagrammatic cross-section of a connection assembly according to the invention. The connection assembly has a female connector 15 and a male connector 18. The female connector comprises a box 16 having an entrance window 17 permitting the insertion of a male connector 18. This window 17 is located on the front face of the box. The latter can be fixed by ratching to a support 22 shown in undetailed manner in the drawing. The support 22 can e.g. be fixed to a partition in a dwelling or apartment. Within the said box and facing the window, the female connector also comprises a first group of connection terminals such as 28 and a second group of connection terminals such as 29, which are respectively connected in the manner to be described hereinafter to the corresponding ends of lines such as 32, 33 of the first and second successive sections 7, 8 of the cable of the network of FIG. 1.

Male connector 18 is shown at 26 in its insertion position in the female connector. This connector 18 has connection terminals 21 entering into contact by sliding with the connection terminals 28 corresponding thereto of the female connector. These connection terminals 21 make it possible to connect a terminal to the sections 7, 8 of the network, by an earth shielding multiline connection cable 5. Terminals 21 are of the "insulant piercing" type and are in contact with each conductor 10 of the connection cable of the supplementary apparatus or unit, by piercing the insulting covering 11 surrounding the conductor 10.

The retractable, mobile means 35 give the connector its universal character, as will be shown hereinafter. They make it possible to ensure the continuity of transmissions on the network, particularly between the terminals or stations connected to the cable sections 7, 8 of said network prior to the insertion of the male connector. They also make it possible to control the connections of the lines of the connection cable 5 with the lines of the cable sections 7, 8 of the network, as well as the interconnections between the lines of the network cable sections, following the insertion of the male connector into the female connector. Other lines of the sections of the network cable and other undesignated contacts are shown in FIG. 3.

In an embodiment of the invention, the connection assembly also has a shield 23 for the connection terminals of the female connector. This shield forms a sleeve enveloping at least partly a first and a second group of connection terminals 29 of the female connector positioned facing the window 17 within box 16. The male connector 18 also has an outer shield 24, which forms a sleeve at least partly enveloping the connection terminals 21 of said connector. This sleeve can e.g. be a metallized layer deposited on the insulating support 25 of the connection terminals 21. This support is also provided with an elastic lever 26 making it possible to hold the male connector in position in the female connector, as a result of its ratching on the front face of box 16. The metallized sleeve 24 is contacted, by crimping and in a manner not shown in the drawing, with the shield 13, 14 (FIG. 2) of the connection cable 5.

The male connector shielding sleeve 24 enters into contact, during insertion, with the female connector shielding sleeve 23. A good electrical contact between these two sleeves is e.g. ensured by two elastic tongues, such as 27 and 75, as will be more readily apparent on considering the description of FIG. 6, which are produced in sleeve 23 and bear on the male connector shielding sleeve 24 on either side thereof.

The connection assembly also has means, to be described hereinafter relative to FIG. 5, for ensuring the electrical continuity between the female connector shield 23 and the shield of each section of the network. These means in particular comprise the connection terminals of the female connector, contacts connected to these terminals and connected respectively to the conductive shielding lines of the cable sections 7, 8 of the network and an electric U-link belonging to the retractable, mobile means 35 within the female connector.

FIG. 4 is a more detailed, diagrammatic cross-section of the connection assembly according to the invention. FIG. 4 provides a better understanding of the structure of the mobile, retractable means 35 making it possible to ensure the continuity of the transmissions on the network prior to the insertion of the male connector and the establishment of the links between the network and the terminal connected to the male connector, during the insertion of the latter into the female connector. The same elements carry the same references in this drawing as in FIG. 3.

The terminals 28 of the first group of connection terminals of the female connector are respectively connected by first connection means to the ends of the lines, such as line 32, of the first network cable section 7. These first connection means will be described hereinafter The terminals 29 of the second group of connection terminals of the female connector are respectively connected by second connection means, to be described hereinafter, to the ends of the lines, such as line 33, of the second network cable section 8. The terminals 28, 29 of the first and second groups are respectively located facing one another.

If each cable section, such as that described relative to FIG. 2, has eight lines, the first and second groups of terminals 28, 29 respectively have eight terminals. A single terminal of each group is shown in this drawing.

The mobile, retractable, electric linking means 35 moved by sliding between the first and second groups of terminals 28, 29, under the thrust of the male connector 18 during its insertion. These retractable means have an insulating support 36 and a group of U-links 37, 38. Each U-link has two branches with identical lengths. Prior to the complete insertion of the male connector 18 in the female connector, the two branches 37A, 37B or 38A, 38B of each U-link such as 37 or 38 are respectively in contact with a terminal, such as 28 of the first group and a terminal, such as 29 of the second group, no matter what the length L1 or L2 of the considered U-link branches, said length being measured parallel to the longitudinal axis X'X of the female connector. Thus, for reasons to be indicated hereinafter, the branches of all the U-links of the group can all have the same first length L1 (as for U-link 37 in the drawing), or all have a second identical length L2 (as for U-link 38), which is less than the first length L1. It is also possible for the group of U-links held by the insulating support 36 for the U-links of a first assembly to have branches with the first length L1 and U-links of a second assembly to have branches with the second length L2. This U-link branch length choice possibility gives the connection assembly its universal character. Thus, as a result of this choice and as will be shown hereinafter, it is possible after insertion of the male connector to ensure data transmissions to the terminal and also a continuity of transmissions on all the lines of the network connected to the female connector, or to bring about a total or partial break in the transmissions on the lines of the network.

As shown in the drawing, the terminals 21 of the male connector respectively come into contact by sliding with the terminals 28 of the first group of the female connector, at the time of inserting the male connector.

The retractable, mobile means 34 are shown in said drawing in the retracted position, the male connector 18 being inserted in the female connector. (These retractable means are in the so-called "free" or "non-embedded" position, when the male connector is not inserted). They are moved by a spring 39 bearing on the bottom of a recess 40 produced in two insulating support blocks 41, 47, whose structure will be described in greater detail hereinafter.

The first connection means have a first group of line contacts, such as contact 43, which traverses a first insulating support block 41, which is rendered integral with box 16 by means not shown in detail in the drawing. These line contacts of the first group respectively issue onto a first and a second faces 44, 45 of said first support block. In the same way, the second connection means have a second group of line contacts, such as contact 46, which traverse the second insulating support block 47, which can be rendered integral with box 16. These contacts 46 of the second group respectively issue onto a first and a second faces 48, 49 of the second support block 47.

The contacts 43 of the first group are respectively connected from the side of the first face 44 of the first support block 41 to the ends of the lines, such as 32, of the first section of the network cable 7. In the same way, the contacts 46 of the second group are respectively connected from the side of the first face 48 of the second support block 47 to the ends of the lines, such as 33, of the second cable section 8 of the network.

The contacts 43 of the first group are connected, from the side of the second face 45 of the first support block 41, to a first circuit 50. This first circuit is a printed circuit having tracks respectively connected to the connection terminals 28 of the first group and to the ends of contacts 43, so as to ensure the electrical connection between the terminals 28 of the first group and the lines 32 of the first network cable section 7.

In the same way, the contacts 46 of the second group are respectively connected, from the side of the first face 48 of the second support block 47, to the line ends 33 of the second network cable section 8. These contacts are also connected, from the side of the second face 49 of the second support block 47, to a second circuit 51, which is a printed circuit having tracks respectively connected to the connection terminals 29 of the second group. In this way, the electrical connection is ensured between the connection terminals 29 of the second group 29 and the lines 33 of the second network cable section 8.

The first faces 44, 48 of the first and second support blocks 41, 47 are respectively positioned facing two inner side faces of box 16. The second faces 45, 49 of the first and second support blocks 41, 47 are positioned facing one another. Recess 40 contains the two printed circuits and the two blocks can be assembled and positioned by not designated positioning pins.

Each line contact, such as contacts 43, 46 of the first and second groups, is a cutting fork, auto-baring contact 55. The end of each line, such as 32, of the first or second section is inserted in said fork, which cuts the insulating covering surrounding the conductor of said line. Electrical contact is ensured by gripping the conductor in the fork.

This insertion, as well as the maintaining in position of each line, are facilitated by the use of insulating insertion pushbutton, such as pushbutton 56, which has an opening 57 with a size close to that of the insulating covering of line 32. The end of line 32 is introduced into said opening, which is thus joined to the pushbutton. The insertion of said pushbutton in a recess 58 surrounding the contact in the corresponding support block 41 or 47, from the side of the first face 44 or 48 of said support block, brings about the cutting of the insulating covering by the cutting fork 55, as well as the gripping of the conductor surrounded by the latter. The recesses 58 of pushbuttons 56 are extended towards the rear face of box 16 in the direction of arrow 59 by not shown channels. They respectively make it possible to contain the lines of the considered section of each cable in the vicinity of their ends.

FIG. 5 diagrammatically and in cross-section shows a partial view of the female connector in the vicinity of the shielding sleeve 23. The same elements carry the same references in this drawing as in the preceding drawings. The means making it possible to ensure the electrical continuity between the shield 23 of the female connector and the shield of each section of the network have in each case two support block 41, 47, as well as a supplementary contact and pushbutton, whose structure and arrangement are identical to those of each pushbutton and line contact described hereinbefore.

FIG. 5 does not show the supplementary pushbuttons, which are identical to pushbuttons 56 in the previous drawing. The supplementary contacts are designated 60, 61 in FIG. 5. Each contact is connected from the side of the first face of the support block corresponding thereto to a shielding line in contact with the shield of the corresponding cable section of the network. Thus, for example, the supplementary contact 60 is connected to a line 62 of the first network section 7 (FIG. 4). Thus, this line corresponds to line 13 of FIG. 2. In the same way, the supplementary contact 61 of the second support block 47 is connected to a shielding line 63 in contact with the shield of the second network cable section 8 (FIG. 2).

Each supplementary contact is connected from the side of the second face 45 or 49 of support block 41 or 47 correspoding thereto to a supplementary track of the corresponding printed circuit. Thus, for example, the supplementary contact 60 is connected, from the side of the second face 45 of the first support block 41, to a supplementary track 65 of the first printed circuit 50. In the same way, the supplementary contact 61 is connected, from the side of the second face 49 of the second block 47, to a supplementary track 66 of the second printed circuit 51. The supplementary track 65 of the first printed circuit 50 is connected to the shielding sleeve 23 of the female connector, e.g. by a metal tongue 67 having a fork at its end 68. This fork grips the supplementary track 65, so as to ensure the electrical continuity between the shielding line 62 of the first network section 7 and the shielding line 23, via the supplementary contact 60.

The supplementary track 66 connected to the shielding line 63 of the second network cable section 8 is here connected to the shielding sleeve 23 of the female connector by a means comprising a supplementary terminal 70 of the second group of connection terminals of the female connector, a supplementary U-link 71 of the retractable, mobile means 35 and a supplementary terminal 72 of the first group of connection terminals of the female connector, connected to the supplementary track 65 of the first printed circuit 50. The supplementary U-link 71 is in permanent contact, both before and after insertion, with the supplementary terminals 70 and 72, no matter whether or not the male connector is inserted in the female connector. Thus, a shielding continuity is permanently ensured between the shield of the female connector and the shields of the network cable sections when the male connector is inserted in the female connector, the outer shield 24 (FIG. 3) of said connector entering into contact with the shield 23 of the female connector. The retractable means 35 are moved by the male connector and make it possible to ensure, as a result of the supplementary U-link 71, the electrical continuity between the shield 24 of the male connector, the shield 23 of the female connector and the shielding lines 62, 63 of the network cable sections. The supplementary U-link 71 has a shape identical to that of the U-links 37 of FIG. 4.

The continuity of the shielding between the shielding sleeve 23 and the shielding lines 62, 63 of the network cables could also be obtained without using supplementary connection terminals and supplementary U-links. It would e.g. be possible to use a second tongue of sleeve 23, comparable to tongue 67 and having a fork in contact with the supplementary track 66 of the second printed circuit 50. It would also be possible to ensure the continuity of the shields by connecting wires connecting the sleeve 23 to each of the supplementary tracks 65, 66 of the first and second printed circuits 50, 51.

FIG. 6 is a diagrammatic longitudinal section showing the interior of the female connector, in a plane adjacent to the second face 43 of the first support block 41 and mobile means 35. The same elements carry the same references in said drawing and the preceding drawings. It is assumed that the male connector 18 is not completely inserted in the female connector. It is possible to see in the drawing the shielding sleeve 23 of the female connector, the first group of connection terminals 28 and the contact tongues 27, 75. It is also possible to see the mobile means 35 in their two positions, namely retracted A, or free B. It is also possible to see, e.g. a first U-link assembly 37 having the first link L1, a second U-link assembly 38 having the second length L2, which is less than the first length. It is also possible to see the link between the ends of the terminals 28 of the first group and the connecting pieces 73 of the first printed circuit 50. It is also possible to see the supplementary track 65 of the first printed circuit 50 in contact with tongues 67, which electrically connects said supplementary track to the shielding sleeve 23. The connecting track 74 of the printed circuit making it possible to connect the terminals 28 of the first group to the contacts 43 ensuring the connection with the lines of the first cable section 7 are partly shown. As is diagrammatically indicated in broken line form 76, the supplementary track 65 is connected to the supplementary terminal 72 of the first group. It is also possible to see the supplementary U-link 71 ensuring the electrical continuity between the supplementary terminal 72 of the first group and the supplementary terminal 70 of the second group (FIG. 5).

The connection assembly according to the invention also has in the window 17 permitting the insertion of the male connector, foolproofing means, whose function can be better understood with the aid of FIGS. 7 and 8. Window 17 is shown from the front in these two drawings, whilst the male connector is shown very diagrammatically at 18. The same elements carry the same references as in the preceding drawings.

In FIG. 7, the male connector is intended for the connection of e.g. a telephone terminal to a telephone network. In FIG. 8, the connector is intended for the connection of a data processing terminal to a computer network. FIG. 8 shows that the cross-section of the male connector has a foolproofing boss 80 in a corresponding slide 81 of window 17, whereas in FIG. 7 the cross-section of the male connector has no foolproofing boss. To prevent the connection of a computer data processing terminal to e.g. a telephone data transmission network, into the slide 81 shown in FIG. 7 is introduced a foolproofing means, e.g. constituted by an elastic U-link 82 occupying said slide. This U-link prevents the connection to e.g. a telephone network of a computer terminal connected to a male connector having a foolproofing boss 80. It is also possible to stick to the front face of the box 16 a label indicating the type of network to which the female connector is connected.

Finally and as shown in FIG. 3, the window 17 has a shutter retractable at the moment of inserting the male connector. This retractable shutter can be constituted by a slide flap 83 moved by a spring 84 joined to the box 16. This spring makes it possible to close the window 17 with the slide flap 83 in the absence of a male connector and can open the window when a male connector has to be inserted in the female connector.

The different connections made possible by the connection assembly according to the invention and dependent on the lengths of the U-links used in the mobile, retractable means 35 will be better understood with the aid of FIGS. 9A, 9B, . . . , 11B, 11C. These drawings make clear the universal nature of the connection assembly. The same elements carry the same references as in the preceding drawings.

FIG. 9A diagrammatically shows in perspective, a first embodiment of the mobile, retractable means 35 of FIG. 4. In this embodiment, the insulating support 36 carries a group 90 of identical U-links 37. Each U-link has two branches of the first length L1. There is also a supplementary U-link 71 which, as indicated hereinbefore, ensures the continuity of the earth shields and whose branches also have the first length L1. FIG. 9B diagrammatically shows in perspective, the group 90 of U-links 37 of FIG. 9A, the first group 91 of connection terminals 28 and the second group 92 of connection terminals 29 of the female connector. It is also possible to see the supplementary terminal 72 of the first group and the supplementary terminal 70 of the second group. By contact with the supplementary U-link 71, these supplementary terminals ensure the electrical continuity of the earth shields. The U-links 37 of group 90 and the supplementary U-link 71 are shown in continuous line form when the support 36 is in the free position (i.e. not inserted in the female connector prior to the insertion of the male connector). These U-links are shown in broken line form when support 36 is in the retracted position (i.e. inserted in the female connector prior to the insertion of the male connector).

It is also possible to see the group 93 of connection terminals 21 of the male connector, which on insertion, are respectively in contact with the corresponding terminals 28 of the first group of the female connector.

Figure 9C:
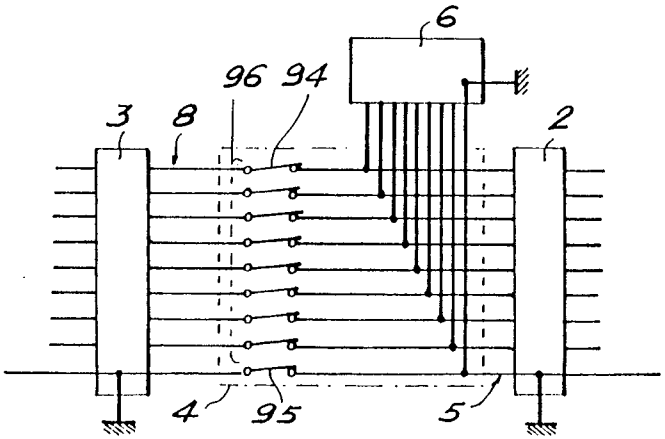

In this embodiment, before and after insertion of the male connector, the terminals 28 of the first group and all the terminals 29 of the second group 91 are permanently electrically connected, no matter whether the support 36 is in the free or retracted position, the first length of the U-links being chosen as a consequence thereof. This also applies with respect to the supplementary terminals 70 and 72 ensuring the continuity of the earth shields, by permanent contact with the supplementary U-link 72. The branching effects obtained in this embodiment are diagrammatically illustrated in FIG. 9C. The connection assembly 4 is diagrammatically represented by a group 96 of switches 94 respectively connected to the cable sections 7, 8 of the network. The supplementary switch 94 is connected to the shielding lines of each section. It is also possible to see the network stations 2 and 3, as well as the terminal 6 connected to the network by the multiline cable 5, which also has an earth or ground shielding line. As indicated hereinbefore, the insertion of the male connector does not break the links between the lines of network sections 7, 8. The switches 94 of group 96 are all in the closed position and diagrammatically represent the continuity of the electrical connections respectively between the terminals 28 of the first group 91 and the terminals 29 of the second group 92. The continuity of the earth shields is represented by the closed position of switch 95.

In this embodiment, on insertion, the transmission lines of the connection cable 5 and the supplementary shielding line of said cable are respectively connected to the transmission lines and to the shielding line of each cable section. There is no break to the connections on the network.

FIG. 10A diagrammatically shows in perspective a second embodiment of the mobile, retractable means 35 of FIG. 4. In this embodiment, the insulating support 36 carries a group 90 of identical U-links 37. Each of the two branches of the U-link has the same second length L2, which is less than the first length L1 of the U-links of FIG. 9A. It is also possible to see the supplementary U-link 71 making it possible, as indicated hereinbefore, to ensure the continuity of the earth shields. The branches of said supplementary U-link have the first length L1, which is greater than the second length L2. FIG. 10B diagrammatically shows in perspective, the group 90 of U-links 38 of FIG. 10A, the first group 91 of connection terminals 28, the second group 92 of connection terminals 29 of the female connector, as well as the supplementary terminal 72 of the first group and the supplementary terminal 70 of the second group of terminals ensuring, by contact with the supplementary U-link 71, the electrical continuity of the earth shields. The U-links 38 of group 90, as well as the supplementary U-link 71 are shown in continuous line form when support 36 is in the free position, (i.e. not embedded in the female connector prior to the insertion of the male connector). These U-links are shown in broken line form when the support 36 is in the retract position (i.e. embedded in the female connector prior to the insertion of the male connector).

It is also possible to see the group 93 of connection terminals 21 of the male connector which, on insertion, are respectively in contact with the corresponding terminals 28 of the first group of the female connector.

In this embodiment, prior to the insertion of the male connector, the terminals 28 of the first group 90 and all the corresponding terminals 29 of the second group 91 are permanently electrically connected, the support 36 not being embedded in the female connector. This also applies with respect to the supplementary terminals 70 and 72 ensuring the continuity of the earth shields, by permanent contact with the supplementary U-link 72, whose branches have the first length (length of the branches of the U-links of FIG. 9A). After insertion and as a result of the smaller length L2 of the U-links 38, there is a breaking of all the links of the network, with the exception of the earth shielding link.

Figure 10C:
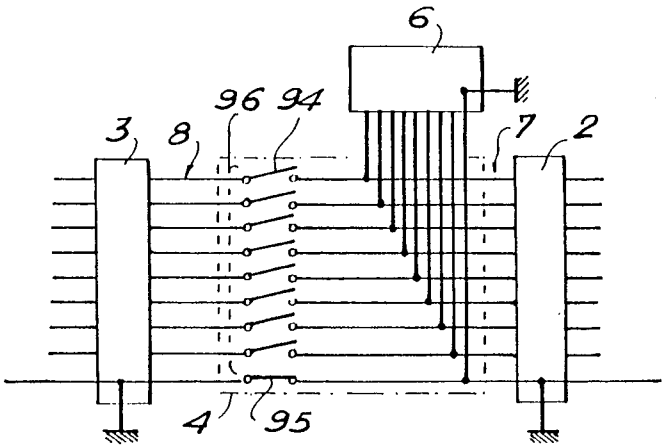

The branching effects obtained in this embodiment are illustrated in FIG. 10C. The connection assembly 4 is diagrammatically represented by a group 96 of switches 94 respectively connected to the network cable sections 7, 8. The supplementary switch 95 is connected to the shielding lines of each section. In this embodiment, the insertion of the male connector brings about a total break in the links between the network sections 7, 8. The switches 94 of group 96 are consequently all in the open position and diagrammatically represent the breaking of the electric links, respectively between terminals 28 of the first group 91 and terminals 29 of the second group 92. The continuity of the earth shields is represented by the closed position of switch 95.

In this embodiment, on insertion, the transmission lines of the connection cable 5 are respectively connected to the lines of cable section 7. The electrical continuity of the shielding is ensured between cable sections, 7, 8 and connection cable 5. Thus, terminal 6 is connected to all the lines of cable section 7 of the network and can communicate with station 2, whilst communication is interrupted on the network between stations 2 and 3.

FIG. 11A shows diagrammatically and in perspective, a third embodiment of the mobile, retractable means 35 of FIG. 4. In this embodiment, the insulating support 36 carries a group 90 of U-links having a first U-link assembly 37 with branches of a first length L1 (length of the branches of the U-links in FIG. 9A) and a second U-link assembly 38 having branches of the second length L2 (length of the U-link branches in FIG. 10A).

It is also possible to see the supplementary U-link 71 making it possible to ensure, as indicated hereinbefore, the continuity of the earth shields. The branches of this U-link are of the first length L1. FIG. 11B diagrammatically shows in perspective the group 90, incorporating a U-link assembly 37 of the first length L1 and a U-link assembly 38 of the second length L2, the first group 91 of connection terminals 28 and the second group 92 of connection terminals 29 of the female connector. It also shows the supplementary terminal 72 of the first group and the supplementary terminal 70 of the second group of terminals ensuring, by contact with the supplementary U-link 71, the electrical continuity of the earth shields. The U-links 37, 38 of each assembly of the U-link group 90, as well as the supplementary U-link 71 are shown in continuous line form when the support 36 is in the free position (i.e. not embedded in the female connector prior to the insertion of the male connector). These U-links are shown in broken line form when the support 36 is in the retracted position (i.e. embedded in the female connector prior to the insertion of the male connector).

It is also possible to see the group 93 of connection terminals 21 of the male connector which, on insertion, are respectively in contact with the corresponding terminals 28 of the first group of the female connector.

In this embodiment, prior to the insertion of the male connector, the terminals 28 of the first group 90 and all the corresponding terminals 29 of the second group 91 are permanently electrically linked. This also applies with regards to the supplementary terminals 70, 72 ensuring the continuity of the earth shields by permanent contact with the supplementary U-link 72. Following the insertion of the male connector, the links are interrupted on the lines of the network, which are connected to the connection terminals of the female connector corresponding respectively to the U-links 38 of the second assembly. However, the links are maintained on the lines of the network connected to the connection terminals of the female connector, which respectively correspond to the U-links 37 of the first assembly.

The branching effects obtained in this embodiment are illustrated in FIG. 11C. The connection assembly 4 is diagrammatically represented by a group 96 of switches respectively connected to the cable section 7, 8 of the network. The supplementary switch 95 is connected to the shielding lines of each section. As stated hereinbefore, the insertion of the male connector brings about the breaking of the links between the lines of network sections 7, 8 corresponding respectively to the U-links 38, which is illustrated in this drawing by an open switch assembly 98. However, the links are maintained on the network lines respectively corresponding to U-links 37, which is illustrated in the drawing by a closed switch assembly 99. The continuity of the earth shields is represented by the closed position of switch 95.

In this embodiment, there is a partial breaking of the connections on the network (on the lines of sections 7 and 8 respectively connected to the terminals 28, 29 respectively corresponding to the U-link assembly 38 of the second length) and there is a partial maintenance of these links (on the lines of sections 7, 8 respectively connected to the terminals 28, 29 corresponding respectively to the U-link assembly 37 of the first length).

Terminal 6 is connected to all the lines of section 7 and is partly connected to the lines of section 8.

In all the embodiments, support 36 has slots and openings (not referenced), which make it possible to maintain the U-links on said support.

The connection assembly described hereinbefore has a universality character, because it permits all possible combinations of the branching of a terminal to a network, whilst providing the possibility of obtaining a continuity of the earth shields.

What is claimed is:

1. Universal connection assembly for connecting a processing terminal to a data transmission network by multiline cable comprising:

a female connector (15) having a box (16) provided with an inlet window (17) on a front face of said box and, within the box and facing the window, connection terminals (28, 29) respectively connected to corresponding ends (32, 33) of transmission lines of a first and a second successive sections (7, 8) of cables of the network;

a male connector (18) having connection terminals (21) respectively connected to lines of a multiline connection cable (5) of said terminal (6), the connection terminals (21) of the male connector respectively coming into contact, by sliding, with the corresponding terminals (28) of the female connector, during the insertion of the male connector into said window for connecting the terminal to the network;

characterized in that it comprises:

a first group of connection terminals (28) of the female connector respectively connected by first connection means (43, 50) to the corresponding ends of cable lines of the first section (7) and respectively coming into contact with the connection terminals (21) of the male connector during said insertion;

a second group of connection terminals (29) of the female connector respectively connected by second connection means (46, 51) to corresponding ends of the lines of the cable of the second section (8);

and the electrical linking means (35), which are mobile and retractable under the thrust of the male connector on insertion, located within the female connector and moving between the terminals (28, 29) of the first and second groups of the female connector, in order to ensure the continuity of communications on the network prior to said insertion and for ensuring the connection of the terminal (6) to the network after said insertion.

2. Connection assembly according to claim 1, characterized in that said window (17) has foolproofing means (81, 82) for preventing the connection of a computer terminal to a telephone data transmission network.

3. Connection assembly according to claim 1, characterized in that the mobile means of the electrical links (35) have a mobile support (36) moved by the male connector (18) during insertion and a group (90) of electric U-links, each link having two branches respectively in contact with a terminal (28) of the first group and with a corresponding terminal (29) of the second group of the female connector, prior to insertion, all or some of the U-links of said group having branches (37A, 37B–38A, 38B) of a first and/or a second length (L1, L2).

4. Connection assembly according to claim 3, characterized in that the U-links (37) have all the branches (37A, 38B) of the first length (L1) for ensuring the continuity of the electrical connection, after insertion, between the terminals (28) of the first group of the female connector and the respectively corresponding terminals (29) of the second group of the female connector.

5. Connection assembly according to claim 4, characterized in that the first and second connection means respectively incorporate a first and a second group of contacts (43, 46) of lines respectively traversing a first and a second support blocks (41, 47), which are of an insulating nature and can be integrated with the box, said contacts respectively issuing onto a first and second faces (44, 45) or (48, 49) of each support block, the contacts of lines (43, 46) of the first and second groups being respectively connected, from the side of the first face (44 or 48) of each support block (41 or 47), to the ends of the lines (32, 33) of the first and second network sections (7, 8) and being respectively connected, from the side of the second face (45 or 49) of each support block, to a first and a second circuits (50, 51) respectively connecting the terminals (28) of the first group to the contacts of the lines (43) of the first group and the terminals (29) of the second group to the contacts of the lines (46) of the second group.

6. Connection assembly according to claim 5 characterized in that the first faces (44, 48) of the first and second support blocks (41, 47) are respectively positioned facing two internal side faces of the box (16), the second faces (45, 49) of the first and second support blocks facing one another, the first and second circuits (50, 51) being printed circuits having tracks respectively connected to the terminals (28, 29) of the first and second groups of terminals of the female connector.

7. Connection assembly according to claim 1 and 6, characterized in that said window (17) has a shutter (83), which can be retracted on inserting the male connector (18).

8. Connection assembly according to claim 3, characterized in that the U-links (38) have all branches (38A, 38B) of the second length (L2) so that, after insertion, the electrical links are interrupted between the terminals (28) of the first group of the female connector and the respectively corresponding terminals (29) of the second group of the female connector.

9. Connection assembly according to claim 8, characterized in that the first and second connection means respectively incorporate a first and a second group of contacts (43, 46) of lines respectively traversing a first and a second support blocks (41, 47), which are of an insulating nature and can be integrated with the box, said contacts respectively issuing onto a first and second faces (44, 45) or (48, 49) of each support block, the contacts of lines (43, 46) of the first and second groups being respectively connected, from the side of the first face (44 or 48) of each support block (41 or 47), to the ends of the lines (32, 33) of the first and second network sections (7, 8) and being respectively connected, from the side of the second face (45 or 49) of each support block, to a first and a second circuits (50, 51) respectively connecting the terminals (28) of the first group to the contacts of the lines (43) of the first group and the terminals (29) of the second group to the contacts of the lines (46) of the second group.

10. Connection assembly according to claim 9 characterized in that the first faces (44, 48) of the first and second support blocks (41, 47) are respectively positioned facing two internal side faces of the box (16), the second faces (45, 49) of the first and second support blocks facing one another, the first and second circuits (50, 51) being printed circuits having tracks respectively connected to the terminals (28, 29) of the first and second groups of terminals of the female connector.

11. Connection assembly according to claim 8, characterized in that each contact of lines (43 or 46) of the first and second groups is a cutting fork self-baring contact (55) in which is inserted the end of the corresponding line of the network cable section, each line being a conductor (10) surrounded by an insulating covering (11), the insertion of the end of the line into the line contact bringing about the cutting off of the insulating covering and the gripping of the conductor by the fork.

12. Connection assembly according to claim 11 characterized in that each line contact (43 or 46) is provided with an insulating pushbutton (56) for inserting the corresponding line end of the network cable section, said pushbutton being joined to said line end and is embedded in a recess (58) surrounding the line contact in the support block, from the side of the first face (44 or 48) of said support block, in order to bring about the cutting off of the covering and the gripping of the said conductor at the end of the line, each support block having on the side of the first face (44 or 48) channels for receiving the lines of the corresponding cable section, in the vicinity of the ends of said lines, said channels being oriented towards a rear face of the box (16).

13. Connection assembly according to claim 12 characterized in that the means for ensuring the electrical continuity between the shield of the female connector and the shielding line of each cable section of the network have in each of the support blocks (41, 47), a contact (60 or 61) and a supplementary insulating pushbutton having a structure and arrangement identical to those of each pushbutton (56) and line contact (43), said contact being connected, from the side of the first face of the corresponding support block, to the shielding line (62 or 63) of the corresponding network section (7 or 8) and from the side of the second face (45 or 49) to a supplementary track (65 or 66) of the corresponding printed circuit (50 or 51), said supplementary track being connected to the shield (23) of the female connector.

14. Connection assembly according to claim 13 characterized in that the supplementary track (65) of the first printed circuit (50) is connected to the shield (23) of the female connector by direct contact with said shield, the supplementary track (66) of the second printed circuit (51) being connected to the shield (23) of the female connector by a supplementary terminal (72) of the first group, connected to the supplementary track (65) of the first printed circuit by a supplementary terminal (70) of the second group connected to the supplementary track (66) of the second printed circuit (51) and by a supplementary U-link (71) of the retractable linking means (35), said supplementary U-link being in contact with the supplementary terminals (70, 72) of the first and second groups, before and after the insertion of the male connector (18).

15. Connection assembly according to claim 3, characterized in that the U-links (37) of the first assembly have branches (37A, 37B) of the first length (L1) and U-links (38) of the second assembly have branches (37A, 38B) of the second length (L2) so that, after insertion, they ensure the continuity of the electrical connections respectively between the terminals of a first terminal assembly (28, 29) of the first and second groups of the female connector and in order to interrupt the electrical connections respectively between the terminals of a second terminal assembly (28, 29) of the first and second groups of the female connector.

16. Connection assembly according to claim 15, characterized in that the first and second connection means respectively incorporate a first and a second group of contacts (43, 46) of lines respectively traversing a first and a second support blocks (41, 47), which are of an insulating nature and can be integrated with the box, said contacts respectively issuing onto a first and second faces (44, 45) or (48, 49) of each support block, the contacts of lines (43, 46) of the first and second groups being respectively connected, from the side of the first face (44 or 48) of each support block (41 or 47), to the ends of the lines (32, 33) of the first and second network sections (7, 8) and being respectively connected, from the side of the second face (45 or 49) of each support block, to a first and a second circuits (50, 51) respectively connecting the terminals (28) of the first group to the contacts of the lines (43) of the first group and the terminals (29) of the second group to the contacts of the lines (46) of the second group.

17. Connection assembly according to claim 16 characterized in that the first faces (44, 48) of the first and second support blocks (41, 47) are respectively positioned facing two internal side faces of the box (16), the second faces (45, 49) of the first and second support blocks facing one another, the first and second circuits (50, 51) being printed circuits having tracks respectively connected to the terminals (28, 29) of the first and second groups of terminals of the female connector.

18. Connection assembly according to claim 3, characterized in that it comprises:

a shield (23) for the connection terminals (28, 29) of the female connector forming a sleeve at least partly enveloping the connection terminals of the female connector within said box and means (61, 62, 65, 67, 70, 71, 72, 66) for ensuring the electrical continuity of the shield of the female connector with the respective shielding lines (62, 63) of the first and second sections of cables of the network, a shield (24) outside the male connector forming another sleeve partly enveloping the terminals (21) of the male connector, said sleeve being in contact with a shielding line of said connecting cable (5) of the terminal (6) and coming into contact with the shield (23) of the female connector during insertion.

19. Connection assembly according to claim 18, characterized in that the first and second connection means respectively incorporate a first and a second group of contacts (43, 46) of lines respectively traversing a first and a second support blocks (41, 47), which are of an insulating nature and can be integrated with the box, said contacts respectively issuing onto a first and second faces (44, 45) or (48, 49) of each support block, the contacts of lines (43, 46) of the first and second groups being respectively connected, from the side of the first face (44 or 48) of each support block (41 or 47), to the ends of the lines (32, 33) of the first and second network sections (7, 8) and being respectively connected, from the side of the second face (45 or 49) of each support block, to a first and a second circuits (50, 51) respectively connecting the terminals (28) of the first group to the contacts of the lines (43) of the first group and the terminals (29) of the second group to the contacts of the lines (46) of the second group.

20. Connection assembly according to claim 19 characterized in that the first faces (44, 48) of the first and second support blocks (41, 47) are respectively positioned facing two internal side faces of the box (16), the second faces (45, 49) of the first and second support blocks facing one another, the first and second circuits (50, 51) being printed circuits having tracks respectively connected to the terminals (28, 29) of the first and second groups of terminals of the female connector.

21. Connection assembly according to claim 3, characterized in that the first and second connection means respectively incorporate a first and a second group of contacts (43, 46) of lines respectively traversing a first and a second support blocks (41, 47), which are of an insulating nature and can be integrated with the box, said contacts respectively issuing onto a first and second faces (44, 45) or (48, 49) of each support block, the contacts of lines (43, 46) of the first and second groups being respectively connected, from the side of the first face (44 or 48) of each support block (41 or 47), to the ends of the lines (32, 33) of the first and second network sections (7, 8) and being respectively connected, from the side of the second face (45 or 49) of each support block, to a first and a second circuits (50, 51) respectively connecting the terminals (28) of the first group to the contacts of the lines (43) of the first group and the terminals (29) of the second group to the contacts of the lines (46) of the second group.

22. Connection assembly according to claim 21 characterized in that the first faces (44, 48) of the first and second support blocks (41, 47) are respectively positioned facing two internal side faces of the box (16), the second faces (45, 49) of the first and second support blocks facing one another, the first and second circuits (50, 51) being printed circuits having tracks respectively connected to the terminals (28, 29) of the first and second groups of terminals of the female connector.

* * * * *